US008319626B1

(12) United States Patent
Cantolino

(10) Patent No.: US 8,319,626 B1
(45) Date of Patent: Nov. 27, 2012

(54) ALARM SYSTEM FOR HOT WATER HEATERS

(76) Inventor: Christopher Ralph Cantolino, Sarasota, FL (US)

( * ) Notice: Subject to any disclaimer, the term of this patent is extended or adjusted under 35 U.S.C. 154(b) by 280 days.

(21) Appl. No.: 12/832,053

(22) Filed: Jul. 7, 2010

(51) Int. Cl.
*G08B 29/00* (2006.01)

(52) U.S. Cl. ..... 340/506; 122/13.01; 137/312

(58) Field of Classification Search ..... 340/605; 122/13.01; 137/312
See application file for complete search history.

(56) References Cited

U.S. PATENT DOCUMENTS

| | | | | | |
|---|---|---|---|---|---|
| 3,069,671 | A * | 12/1962 | Taylor | 340/616 |
| 4,944,253 | A * | 7/1990 | Bellofatto | 122/14.21 |
| 5,134,683 | A * | 7/1992 | Powell | 392/449 |
| 5,188,143 | A * | 2/1993 | Krebs | 137/312 |
| 5,229,750 | A * | 7/1993 | Welch et al. | 340/605 |
| 5,315,291 | A * | 5/1994 | Furr | 340/605 |
| 5,334,973 | A * | 8/1994 | Furr | 340/605 |
| 5,632,302 | A * | 5/1997 | Lenoir, Jr. | 137/312 |
| 5,645,103 | A * | 7/1997 | Whittaker | 137/312 |
| 5,877,689 | A * | 3/1999 | D'Amico | 340/605 |
| 5,881,762 | A * | 3/1999 | Janesky | 137/312 |
| 5,934,937 | A * | 8/1999 | McCarthy | 439/583 |
| 6,084,520 | A * | 7/2000 | Salvucci | 340/605 |
| 6,087,584 | A * | 7/2000 | Daoud | 174/50.59 |
| 6,276,309 | B1 * | 8/2001 | Zeek | 122/504 |
| 6,354,322 | B2 * | 3/2002 | Clark | 137/312 |
| 6,526,807 | B1 * | 3/2003 | Doumit et al. | 73/40.5 R |
| 6,639,517 | B1 * | 10/2003 | Chapman et al. | 340/605 |
| 6,766,835 | B1 * | 7/2004 | Fima | 141/95 |
| 7,561,057 | B2 * | 7/2009 | Kates | 340/605 |
| 2004/0161227 | A1 * | 8/2004 | Baxter | 392/454 |
| 2005/0275547 | A1 * | 12/2005 | Kates | 340/605 |
| 2006/0208912 | A1 * | 9/2006 | Fiorletta et al. | 340/605 |
| 2007/0261241 | A1 * | 11/2007 | Akkala et al. | 29/890.03 |
| 2008/0068189 | A1 * | 3/2008 | Murphy | 340/605 |
| 2009/0140866 | A1 * | 6/2009 | Heilmann et al. | 340/605 |
| 2009/0195397 | A1 * | 8/2009 | Murphy | 340/605 |
| 2009/0308332 | A1 * | 12/2009 | Tanbour | 122/14.2 |

* cited by examiner

*Primary Examiner* — Albert Wong
*Assistant Examiner* — Rufus Point
(74) *Attorney, Agent, or Firm* — Dorothy S. Morse

(57) ABSTRACT

An alarm system for a storage hot water heater comprising an alarm housing, power supply leads inserted through the top of a hot water heater tank, a fluid collection pan positioned under the tank, and a fluid detection sensor associated with the pan. The alarm housing is configured to provide prompt owner/operator notification after only a small amount of fluid is collected in the pan under the tank. Owner/operator notification can be provided via audible, visual, and/or remote means, such as but not limited to a signal transmitted to a home security device that is relayed to a 24-hour security monitoring network. Since the alarm housing is hard wired, reliance on batteries is avoided and the system's useful life meets or exceeds that of the associated hot water heater. In addition, the leads never have to be removed from the hot water heater tank and can be made tamper-resistant.

20 Claims, 11 Drawing Sheets

ALARM SYSTEM FOR HOT WATER HEATERS

CROSS-REFERENCES TO RELATED APPLICATIONS

A U.S. patent application was previously filed by the same inventor herein for a fluid collection pan similar to that shown in the accompanying illustrations as a part of the most preferred embodiment of the present invention system, which is entitled "Strength-Enhancing Water-Collecting Pan for Use Under Storage Hot Water Heaters", was filed on Sep. 21, 2009, and has a Ser. No. 12/563,669. The applicant herein claims any and all domestic priority to which he is entitled as a result of this earlier filed and related U.S. utility patent application.

BACKGROUND

1. Field of the Invention

This invention relates to water shut-off devices and alarms used for detection of fluid leaks and notification thereof, specifically to an alarm system for storage hot water heaters which comprises an alarm housing, power supply leads inserted through the top of a hot water heater tank, a fluid collection pan positioned under the hot water heater tank, a fluid detection sensor associated with the fluid collection pan that is aligned with a small opening in the pan, and a pan sensor cable connected between the sensor and the alarm housing so that after only a very small amount of water has been collected in the pan, a portion of that water will pass through the small pan opening and via gravity, and then enter a water collection chamber in the fluid detection sensor that contains the exposed end of the pan sensor cable. Contact of water in the chamber with the end of the pan sensor cable completes an electrical circuit that initiates generation of a leak warning signal by the alarm housing, which has circuitry and components configured to provide prompt owner/operator notification in a variety of ways as soon as the connected fluid sensor is in contact with the threshold amount of water needed to complete the signal generation circuit. Owner/operator notification can be provided via audible means, visual means, and/or remote notification, such as but not limited to a signal transmitted through a home security device to a 24-hour security monitoring network. The alarm housing can be easily mounted on top of the hot water heater tank, or in the alternative can be mounted to a handy box or disconnect box located on a wall (or other surface) near the hot water heater tank. The lead wires inserted through the top of a hot water heater tank are placed in electrical communication with signal generating circuitry positioned within the alarm housing, and as a result of the alarm housing being hard wired, reliance on batteries is avoided, allowing the useful life of the present invention system to typically meet or exceed that of the associated hot water heater with little or no operator inspection or maintenance required. In addition, since the lead wires never have to be removed from the hot water heater tank, their connection can be made tamper-resistant. Also, the fluid detection sensor associated with the water collection pan positioned under the hot water heater tank is connected to the alarm housing via electrical wiring (hereinafter also called a "pan sensor cable") that extends along the exterior surface of the hot water heater tank and is secured thereto in one or more places via small surface mounts to place it in an out-of-the-way position for reduced contact with surroundings. When water leaking slowly from a hot water heater tank first contacts the exposed end of the pan sensor cable positioned within the water collection chamber of the present invention fluid detection sensor, which occurs after only a very small amount of water has accumulated in the pan, an electrical circuit is completed that provides the audible signal, visual signal, and/or remote notification of leak detection so that prompt operator/owner action can take place to avoid water damage to surroundings and/or catastrophic tank failure. Reset of circuitry within the alarm housing will place the present invention system back into its leak detection mode.

2. Description of the Related Art

In residential storage hot water heating systems, about eighty percent of failures are in the form of slow leaks, which when multiplied by the large number of storage hot water heaters in current use can potentially lead to billions of gallons of water lost annually when such leaks remain undetected, and with even more water loss occurring if corrosion of the hot water heater tank is accelerated by slow leaks and results in catastrophic hot water heater tank failure. Since hot water heating systems commonly work for many years after installation without developing a problem, even when little or no owner/operator maintenance takes place (such as the recommended annual cleaning to flush sediments), and as a result it is uncommon for most owners or operators of storage hot water heater tanks to conduct inspections for slow leaks at any time other than in conjunction with the time during which an annual cleaning to flush sediments might take place. If slow leaks do occur and are not promptly detected, leaking water will accelerate the growth of mold on and around the hot water heater tank, all of which contribute to accelerated tank corrosion that will reduce its useful life. In addition, the risk of catastrophic tank failure is increased when corrosion occurs, where many more gallons of water can be lost, particularly if the water pressure in the cold water pipe leading into the hot water heater tank is strong and no one promptly becomes aware of the tank failure. Thus, there is a need for a device or system to monitor storage hot water tanks for slow leaks and provide prompt notification about them as soon as possible after such leaks start to divert water from the tank. The present invention system is configured to promptly detect slow leaks in a storage hot water heater tank, while also providing notification about the leak to the owner or operator of the tank via audible, visual, and/or remote notification means. As part of the present invention, power supply leads are inserted directly into the top of the storage hot water heater tank targeted for monitoring, where they remain during the useful life of the tank. Via use of a pan sensor cable and an alarm housing, the power supply leads are in electrical communication with a fluid detection sensor associated with a water collection pan positioned under the storage hot water heater tank. It is preferred for the size of the water collection pan to not to extend significantly beyond the footprint of the associated hot water heater tank and have a depth dimension sufficient for collecting water from slow tank leaks without damage to surroundings. However, it is not contemplated for the water collection pan of the present invention to have a fluid collection capacity sufficient to hold the entire contents of a storage hot water heater tank should catastrophic tank failure occur. When a small threshold amount of water collects in the present invention pan from one or more slow tank leaks, it preferably passes through a small opening in the pan that is aligned with a water collection chamber in its fluid detection sensor. The water collected in such a manner within the chamber contacts the exposed end of the pan sensor cable, completing an electrical circuit with components in the alarm housing that initiate the generation of one or more notification signals by the alarm housing that promptly provides owner/operator notification of the storage hot water tank leakage in an attempt to avoid excessive water loss and significant water damage to surroundings. In addition to owner/operator notification, shut off of electrical power and water to the hot water heater tank are also to considered within the scope of the present invention via existing technology, although not discussed in fuether detail within this disclosure. Since the present invention is also hard-wired with the hot water heater, reliance on a potentially forgetful owner/operator for periodic battery replacement is avoided. No other system is known that has the same structure as the present invention, functions in the same manner as the present invention, and/or provides all of the features and advantages of the present invention.

BRIEF SUMMARY OF THE INVENTION

The primary object of this invention is to provide an automated alarm system that gives prompt notification to owners/operators of storage hot water heater tanks when small leaks resulting from internal corrosion first start to occur, so that the amount of water loss experienced as a result thereof is reduced and catastrophic tank failure is avoided. A further object of this invention is to provide an automated alarm system that provides owner/operator notification after only a small amount of water leaves the hot water heater tank and is collected in a pan or other container positioned under the hot water heater tank, making it particularly useful for residential applications. It is a further object of this invention to provide an automated alarm system that is easily installed and requires only brief and infrequent owner/operator action after installation. It is also an object of this invention to provide an automated alarm system having remote notification capability. Another object of this invention is to provide an automated alarm system that has a useful life meeting or exceeding that of its associated hot water heater. A further object of this invention is to provide an automated alarm system having tamper-resistant lead wires extending into the storage hot water heater tank. It is also an object of this invention to provide an automated alarm system that is compact and unobtrusively located so as to reduce interfering contact with its surroundings. In addition, it is an object of this invention to provide an automated alarm system that does not rely on replaceable batteries as its main power source.

The present invention, when properly made and used, will provide an automated alarm system for storage hot water heaters comprising an alarm housing, tamper-resistant power supply leads inserted through the top of a hot water heater tank, a fluid collection pan with a small footprint placed under the hot water heater tank, a fluid detection sensor with a small water collection chamber associated with the fluid collection pan, and a pan sensor cable providing electrical communication between the sensor and the alarm housing. The alarm housing has circuitry and components configured to provide prompt owner/operator notification very soon after fluid is first collected in a pan located under the associated hot water heater tank. Notification can be provided via audible means, visual means, and/or remote notification, such as but not limited to a signal transmitted through a home security device to a 24-hour security monitoring network. The water collection pan positioned under the hot water heater tank is configured to stably support an upright storage hot water heater tank, and this configuration in combination with the configuration of the fluid detection sensor associated with the water collection pan, together facilitate prompt leak detection and prompt owner/operator notification thereof. The alarm housing of the present invention can be easily mounted to the top of the hot water heater tank, or to a handy box or quick disconnect box located on a wall near the tank. Power supply leads are inserted through the top of an associated hot water heater tank and placed in direct electrical communication with the alarm housing, and as a result of being hard wired, reliance on batteries as a main source of power for signal generation by the alarm housing is avoided. Furthermore, since the power supply leads never have to be removed from the hot water heater tank, a tamper-resistant connection may be used. As a result of its easy installation, hard wiring, and tamper-resistant connection, the present invention is particularly useful in residential applications and has a useful life that typically meets or exceeds that of the associated hot water heater. In addition, since the present invention is hard wired and periodic battery replacement is not needed, needed homeowner action/interface is usually minimal, perhaps only a reset of circuitry after signal generation or a power failure, and as a result the present invention does not place a maintenance burden upon the hot water heater owner/operator. The pan under the hot water heater tank is small and does not extend very far beyond the footprint of the hot water heater storage tank, and the fluid detection sensor associated with the pan under the hot water heater tank is also small, leading to prompt notification signal generation, with a connection to the alarm housing via a pan sensor cable held closely in an out-of-the-way position along the exterior surface of the hot water heater tank by at least one cable mount. Also, the present invention's power supply leads are inserted through the top of a hot water heater tank, and are in electrical communication with a sheathed electrical cable through their common connection to the alarm housing. Thus, the present invention's configuration and design are unobtrusive, with its components located so as avoid contact with hot water heater tank surroundings. When a portion of the water collected in the present invention pan first passes through the pan's opening and enters the water collection chamber to make contact with the exposed end of a pan sensor cable connected between the present invention's fluid detection sensor and its alarm housing, an electrical circuit is completed that initiates the generation of an audible signal, a visual signal, and/or remote notification that a water tank leak has been detected. Reset of circuitry associated with the alarm housing will place the present invention system back into its leak detection mode. Therefore, owner/operator notification by the present invention of small leaks in storage hot water heater tanks occurs promptly, with little water loss being experienced. Installation of the present invention is easy, and owner/operator interface with the present invention after installation is brief and infrequent, there is non-reliance on replaceable batteries as a main power supply, and present invention positioning is compact and unobtrusive so as to minimize interfering contact with surroundings. Furthermore, remote owner/operator notification is a present invention option. An alarm system with the features and advantages disclosed herein for the present invention is unknown in the prior art.

Although the description herein provides preferred embodiments of the present invention, it should not be construed as limiting its scope. For example, variations in the location, size, and perimeter configuration of its alarm housing; the size of the present invention's power supply leads, the size and configuration of the present invention's fluid detection sensor, whether a 120-V or 240-V power supply is used with the present invention's alarm housing, and the means of electrical connection between the present invention's fluid detection sensor and its alarm housing, other than those shown and described herein, may be incorporated into the present invention. Thus, the scope of the present invention should be determined by the appended claims and their legal equivalents, rather than being limited to the examples given.

COMPONENT LIST

Figure 1:
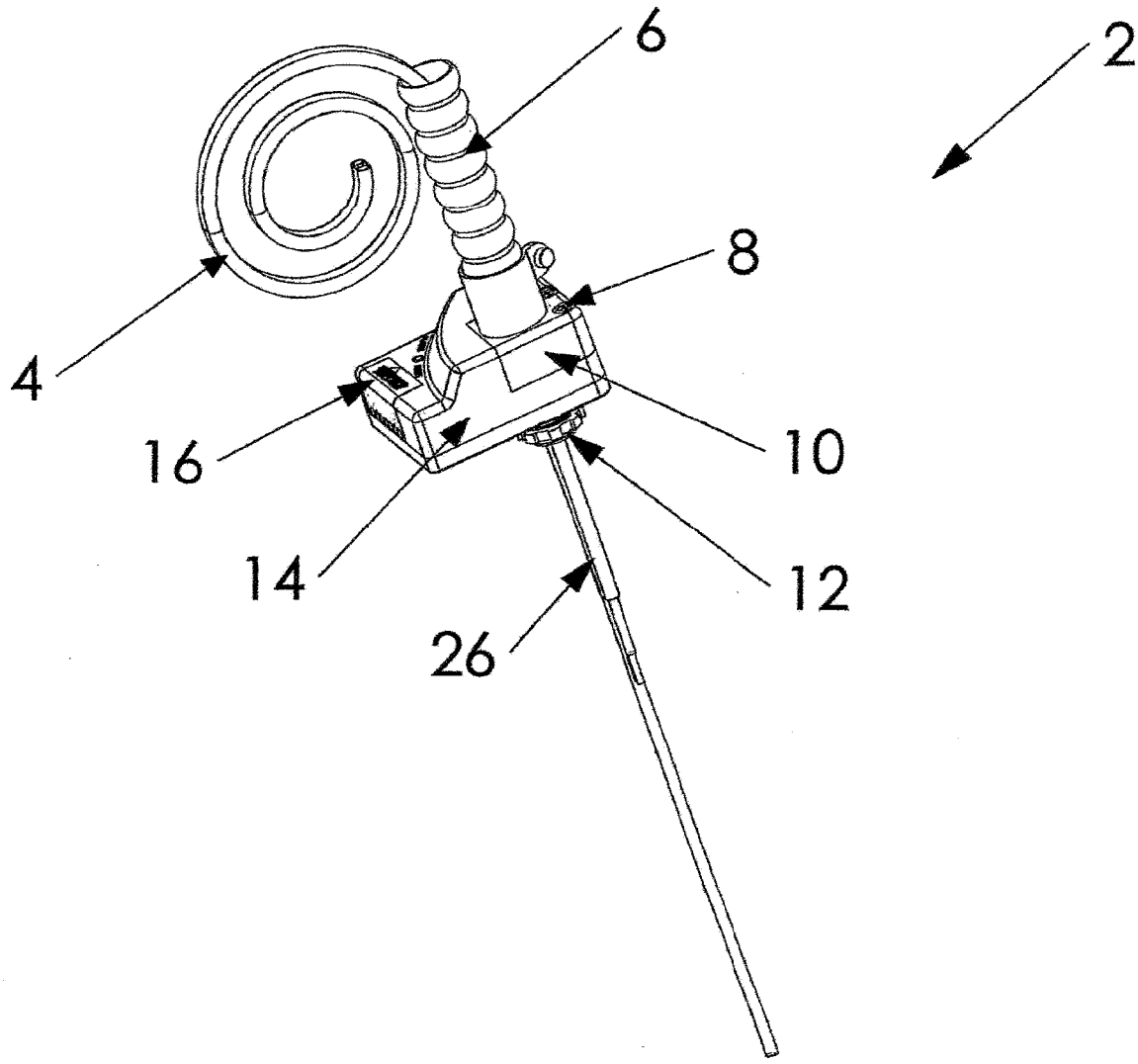
FIG. 1 is a perspective view of the automated alarm assembly for a hot water heater tank used as a part of the most preferred embodiment of the present invention, with the assembly shown comprising a sheathed electrical cable extending upwardly from an alarm housing and secured by an EMT connector with an adjustable clamp through the top portion of an alarm housing, with the assembly also shown comprising power supply leads substantially aligned with the sheathed electrical cable and extending downwardly from the bottom of the alarm housing in an opposed direction from the sheathed cable.

2—automated alarm assembly for storage hot water heater tank 58, with the assembly comprising sheathed electrical cable 4, EMT connector 6 with adjustable clamp 44 (See FIG. 3), nut 12, the top portion 14 of alarm housing 60, and power supply leads 26

4—sheathed electrical cable

Figure 3:
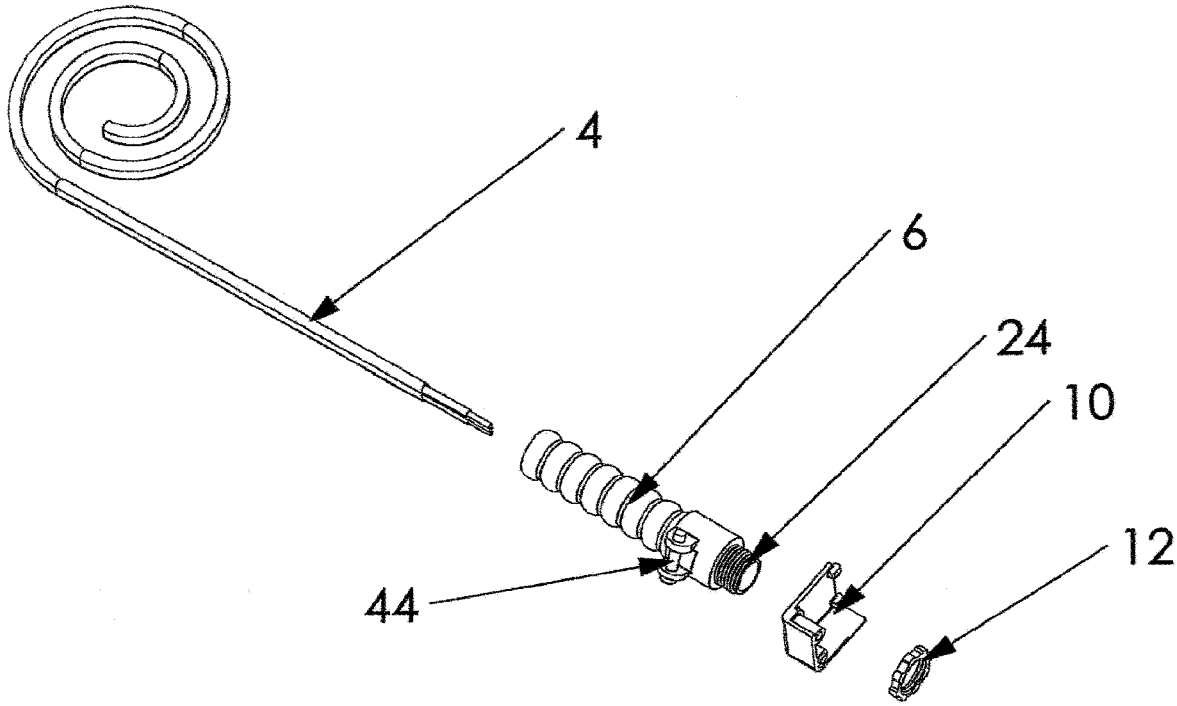
FIG. 3 is an exploded view of the upper portion of the automated alarm assembly shown in FIG. 1, which provides electrical power to internal components within the alarm housing for signal generation.

6—EMT connector with adjustable clamp 44 with threaded stem 24 (see FIG. 3)

8—self-tapping Phillips screws (used with line feed cover 10 and base 22)

10—line feed cover (has knockout panel 48)

12—nut (two are used, one to secure the threaded stem 24 of EMT connector 6 to line feed cover 10 and the second to secure the threaded stem 24 of base 22 during installation of alarm housing 60)

14—top portion of alarm housing 60 (preferably made from molded plastic)

16—terminal block cover (removable)

18—alarm/buzzer (electrically connected to printed circuit board 42 within alarm housing 60)

20—reset button extending through the top portion 14 of alarm housing 60 (could be lit to provide a visible indication of leak detection)

22—base of alarm housing 60 (secured to the top portion 14 with screws 8)

24—threaded stem (two are shown, one on EMT connector 6 and the other on base 22)

26—power supply leads inserted through the top of storage hot water heater tank 58

28—cutout area in terminal block cover 16 for electrical wiring/cable connection

30—opening in the top portion 12 of alarm housing 60 (used for reset button 20)

32—transformer (connected to printed circuit board 42 within alarm housing 60)

34—capacitor (connected to printed circuit board 42 within alarm housing 60)

36—terminal block (connected to printed circuit board 42 within alarm housing 60)

38—relay (connected to printed circuit board 42 within alarm housing 60)

40—fastener (within alarm housing 60)

42—printed circuit board (within alarm housing 60)

44—adjustable clamp attached to EMT connector 6 (see FIG. 3)

46—pan sensor cable extending from alarm housing 60 to the fluid detection sensor 70 associated with the water collection pan 68 that is positioned under storage hot water heater tank

58 and provides stable support for tank 58.

48—knockout panel in the top portion 14 of alarm housing 60 that is removed during top installation of alarm housing 60 on storage hot water heater tank 58

50—slots formed through the side of the top portion 14 of alarm housing 60, that allow someone in the immediate vicinity of hot water heater tank 58 to hear the audible signal of the alarm/buzzer 18 positioned under and protected by top portion 14 when water leakage from storage hot water heater tank 58 occurs

52—quick disconnect box (can optionally be used for mounting alarm housing 60 to a wall)

54—handy box (can optionally be used for mounting alarm housing 60 to a wall)

56—pre-formed opening in handy box 54

58—upright storage hot water heater tank

60—alarm housing (can be prepared for connection to a 120-V or 240-V power supply, preferably with length and width dimensions of approximately three inches and a thickness dimension of approximately two inches)

62—hot and cold water pipes servicing storage hot water heater tank 58

64—first surface mount used to maintain pan sensor cable 46 in close association with the outer surface of hot water heater tank 58

66—second surface mount used to bundle surplus pan sensor cable 46 and maintain it in a compact configuration and also maintain adjacent portions of pan sensor cable 46 in close association with the outer surface of hot water heater tank 58

68—water collection pan

70—fluid detection sensor associated with water collection pan 68

72—surplus pan sensor cable 46 in a compact/bundled configuration

74—ring portion of surface mounts 64 and 66 (preferably adjustable)

76—opening through water collection pan 68 for connection of pan sensor cable 46 to fluid detection sensor 70

78—water collection chamber in fluid detection sensor 70 that receives leaked fluid from storage hot water heater tank 58 after it passes through opening 76 in water collection pan 68

80—braces used for upright orientation and stable positioning of the water collection chamber in fluid detection sensor 70 when it is positioned under water collection pan 68, so that prompt signal generation occurs after only a very small amount of water collects in pan 68

82—electrical wiring or cable connected to terminal block 36 in alarm housing 60 (which can be connected to a home security device that further transmits a remote notification signal to a 24-hour security monitoring network that leakage from a storage hot water heater tank 58 has occurred)

DETAILED DESCRIPTION OF THE INVENTION

The present invention provides an automated alarm assembly 2 for a storage hot water heater 58, which comprises an alarm housing 60, power supply leads 26 electrically connected to alarm housing 60 that are inserted through the top of hot water heater tank 58, and a sheathed electrical cable 4 that provides power to alarm housing 60 for signal generation in response to water leakage from associated storage hot water heater tank 58. The sheathed electrical cable 4 is connected to alarm housing 60 via an EMT connector 6 in combination with an adjustable clamp 44 and a threaded stem 24 (see FIG. 3), with the upper portion of connector 6 being made from insulated material. In the most preferred embodiment of the present invention alarm system, automated alarm assembly 2 is used in combination with a water collection pan 68 positioned under and supporting hot water heater tank 58, a fluid detection sensor 70 associated with water collection pan 68, and a pan sensor cable 46 that is electrically connected between fluid detection sensor 70 and alarm housing 60, with internal circuitry and components in alarm housing 60 being configured to provide prompt owner/operator notification when leakage from a storage hot water heater tank 58 is first detected by fluid detection sensor 70. Owner/operator notification can be provided via audible means, visual means, and/or remote notification, such as but not limited to a signal transmitted through a home security device (not shown) that is further connected electronically to a 24-hour security monitoring network. Alarm housing 60 can be easily mounted to the top of storage hot water heater tank 58, or to a handy box 54 or quick disconnect box 52 located on a wall near tank 58. Power supply leads 26 inserted through the top of hot water heater tank 58 are placed in direct electrical communication with alarm housing 60, and as a result of alarm housing 60 being hard wired via sheathed electrical cable 4, reliance on batteries is avoided and the useful life of the present invention system meets or exceeds that of hot water heater 58. In addition, since power supply leads 26 never have to be removed from tank 58, their connection can be made tamper-resistant. The fluid detection sensor 70 associated with the pan 68 positioned under storage hot water heater tank 58 is also connected to alarm housing 60 by a pan sensor cable 46 extending along the exterior surface of tank 58 and secured thereto in an out-of-the-way position via surface mounts 64 and/or 66. When water leakage from storage hot water heater tank 58 first contacts the sensor 70 associated with pan 68, an electrical circuit is completed that initiates signal generation by alarm housing 60 in the form of an audible signal, a visual signal, and/or remote notification of leak detection. After a power outage or signal generation, reset of circuitry located within alarm housing 60 will place the present invention system back into its leak detection mode.

Figure 2:
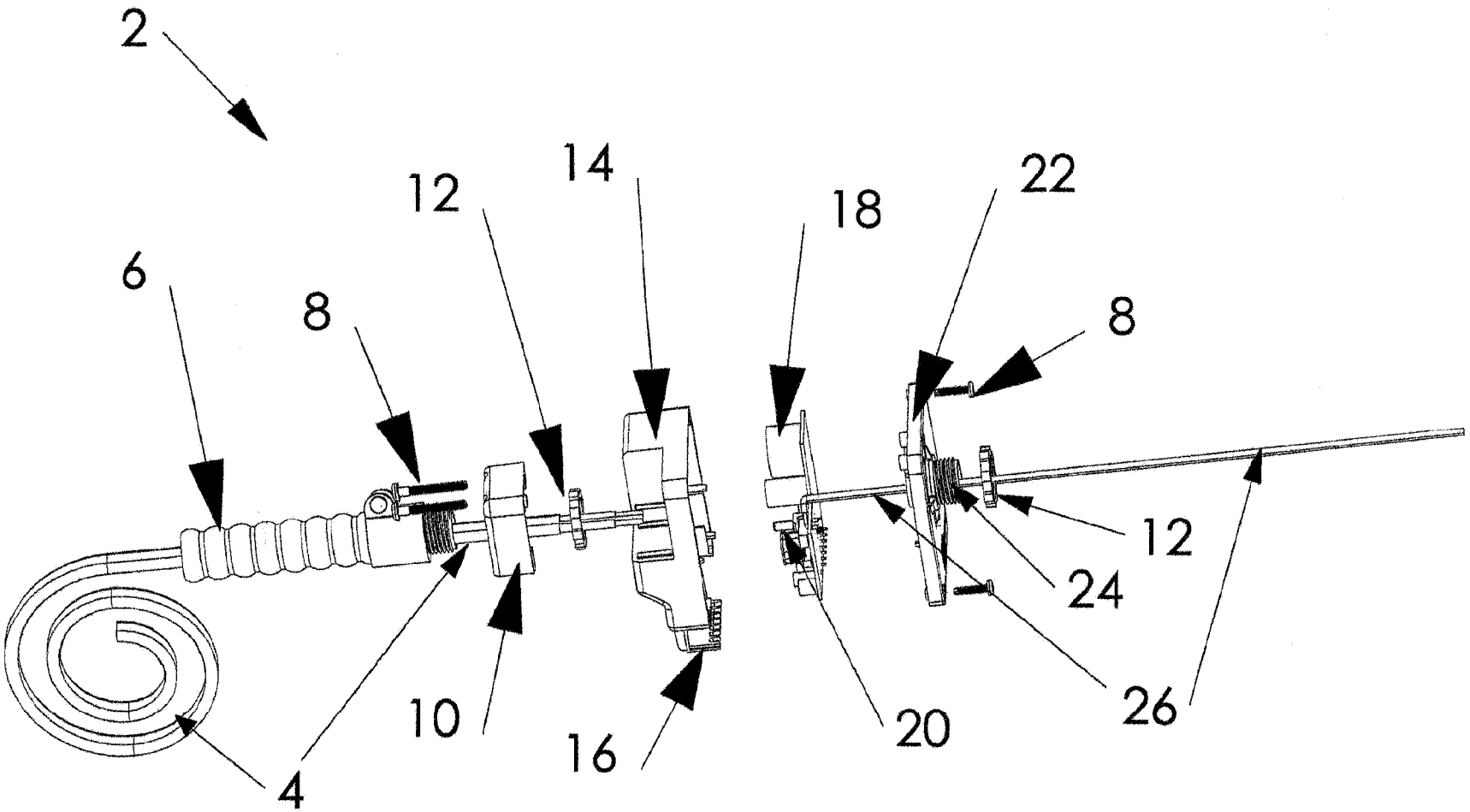
FIG. 2 is an exploded view of the automated alarm assembly shown in FIG. 1.

FIGS. 1 and 2 show the most preferred embodiment of the present invention automated alarm assembly 2 for a storage hot water heater tank 58 that is also used with fluid collection pan 68, fluid detection sensor 70, and pan sensor cable 46 to initiate signal generation in response to fluid leakage from storage hot water heater tank 58. FIG. 1 shows automated alarm assembly 2 in an assembled condition, while FIG. 2 shows automated alarm assembly 2 in an exploded condition. The perspective view in FIG. 1 shows assembly 2 having a sheathed electrical cable 4, an EMT connector 6 in combination with an adjustable clamp (marked with the number 44 in FIG. 3) positioned above the top portion 14 of alarm housing 60 (see FIGS. 7 and 8 for enlarged views of alarm housing 60). FIG. 1 shows alarm housing 60 comprising a top portion 14, while FIG. 2 shows the base 22 that is connected to top portion 14, and which together with top portion 14 protects the internal signal-generating components of alarm housing 60. FIG. 1 further shows power supply leads 26 positioned below alarm housing 60, and extending in an opposed direction downwardly away from alarm housing 60 and the sheathed electrical cable 4. A nut 12 used for the installation of alarm housing 60 is also shown in FIG. 1, along with the terminal block cover 16 and line feed cover 10 that form a part of alarm housing 60. In contrast, the exploded view in FIG. 2 shows the present invention having two nuts 12, with one nut 12 being used to secure the threaded stem 24 (see FIG. 3) associated with EMT connector 6 to line feed cover 10, and the other nut 12 being used to secure base 22 during installation of alarm housing 60 to the top of storage hot water heater tank 58, a quick disconnect box 52 (see FIG. 9), a handy box 54 (see FIG. 10), or other object (not shown). In addition, FIG. 2 shows base 22 having a threaded stem 24 and the two screws 8 to the left of line feed cover 10 that are used to secure it to base 22. FIG. 2 also shows an internal alarm/buzzer 18 protected by the top portion 14 of alarm housing 60, and the reset button 20 that extends through the top portion 14 of alarm housing 60 for use in returning circuitry within alarm housing 60 back into its leak detection mode after a power outage or signal generation occurs. Additionally, FIG. 2 also shows two screws 8 near the threaded stem 24 that are used to secure base 22 to the top portion 14 of alarm housing 60. Although not limited thereto, it is preferred for alarm housing 60 to be made from molded plastic.

Figure 7:
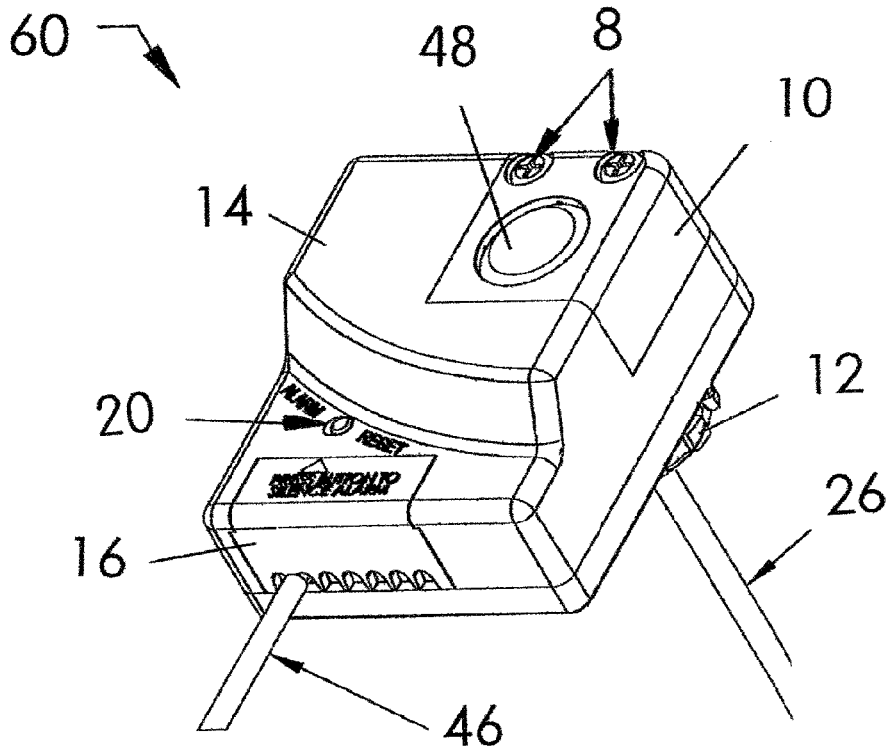
FIG. 7 is a perspective view of the alarm housing in the most preferred embodiment of the present invention having a pan sensor cable and power supply leads connected to it.

In contrast, FIG. 3 shows an exploded view of the upper portion of the automated alarm assembly 2 in the most preferred embodiment of the present invention, which provides the power for alarm housing 60 signal generation. FIG. 3 shows the sheathed electrical cable 4 poised for insertion through an EMT connector 6 with threaded stem 24, and an adjustable clamp 44 around a portion of EMT connector 6. After the knockout panel 48 shown in FIG. 7 is removed from line feed cover 10, threaded stem 24 can be inserted through line feed cover 10 where it becomes secured into its usable position by threaded nut 12. As mentioned above, line feed cover is secured to the top portion 14 of alarm housing 60 via two screws 8 (See FIG. 2). The number of screws 8 or other fasteners used is not critical as long as line feed cover 10 becomes securely fixed to top portion 14. While the configurations and relative dimensions of the EMT connector 6, clamp 44, threaded stem 24, and nut 12 shown in FIG. 3 are preferred, they are not critical.

Figure 4:
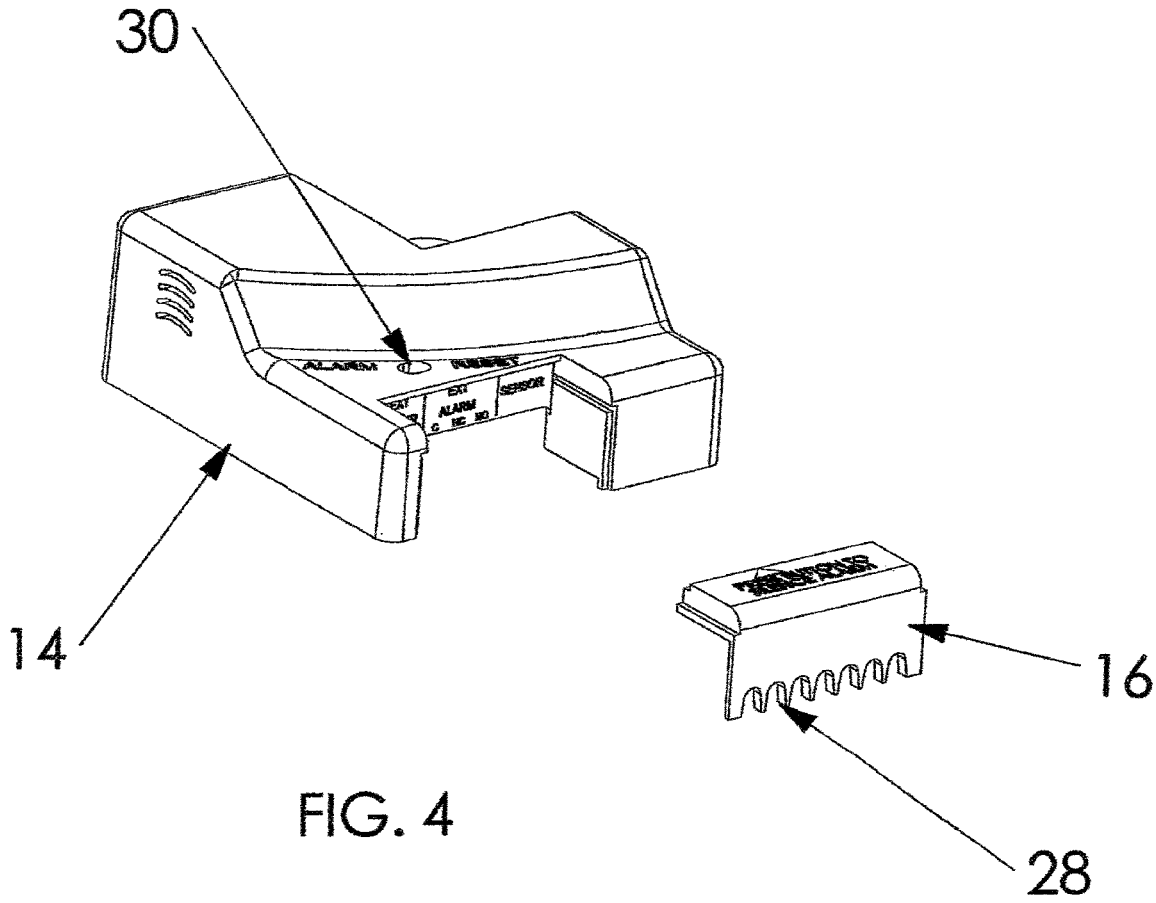
FIG. 4 is an exploded view of the top portion of the alarm housing used as a part of the most preferred embodiment of the present invention, and shows its separable terminal block cover.
Figure 5:
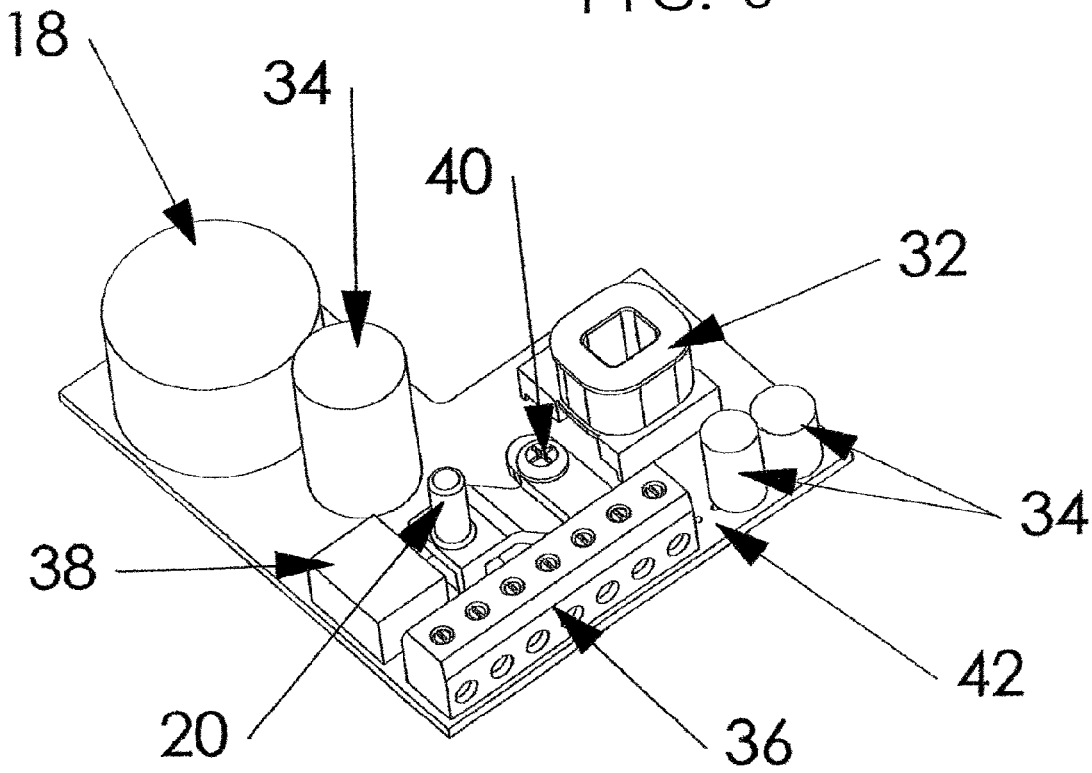
FIG. 5 is a perspective view of internal components in the alarm housing of the most preferred embodiment of the present invention, including a terminal block.
Figure 6:
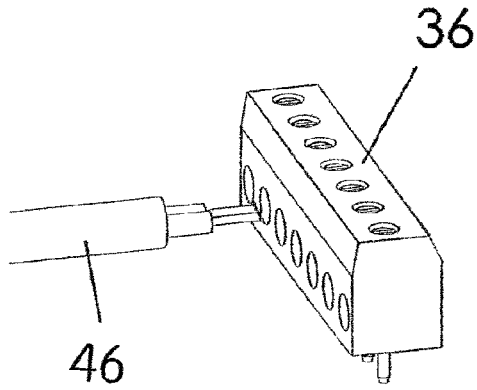
FIG. 6 is a perspective view of pan sensor cable poised for connection to the terminal block shown in FIG. 5.

FIGS. 4-6 provide additional disclosure about the alarm housing 60 in the most preferred embodiment of the present invention. FIG. 4 is an exploded view of the top portion 14 of alarm housing 60 and its terminal block cover 16. Although not shown in enlarged detail, terminal block cover 16 may have a snap-fit connection to top portion 14. However, a snap-fit connection is not critical and other attachment means are also considered to be within the scope of the present invention. FIG. 4 also shows top portion 14 having an opening 30 through it for exposure of reset button 20 (see FIGS. 5 and 7) and operator/owner manipulation thereof, as needed. FIG. 4 further shows the cutout areas 28 in terminal block cover 12 for electrical wiring/cable connection, such as but not limited to that of pan sensor cable 46 (see FIG. 15) or the electrical wiring 82 shown in FIG. 11. In contrast, FIGS. 5 and 6 show preferred internal components of the alarm housing 60 in the most preferred embodiment of the present invention (not necessarily to scale). FIG. 5 shows alarm housing 60 having an internal alarm/buzzer 18, a reset button 20, a transformer 32, several capacitors 34, terminal block 36, relay 38, and a fastener 40. All of the internal components illustrated in FIG. 5 are merely representative thereof, and may differ in size and configuration from that shown. FIG. 6 is a perspective view of pan sensor cable 46 poised for connection to terminal block 36. The configuration and relative dimensions of top portion 14 and terminal block cover 16 may be different from that shown in FIGS. 4-6, as long as alarm housing 60 can provide all of its intended functions and advantages.

Figure 8:
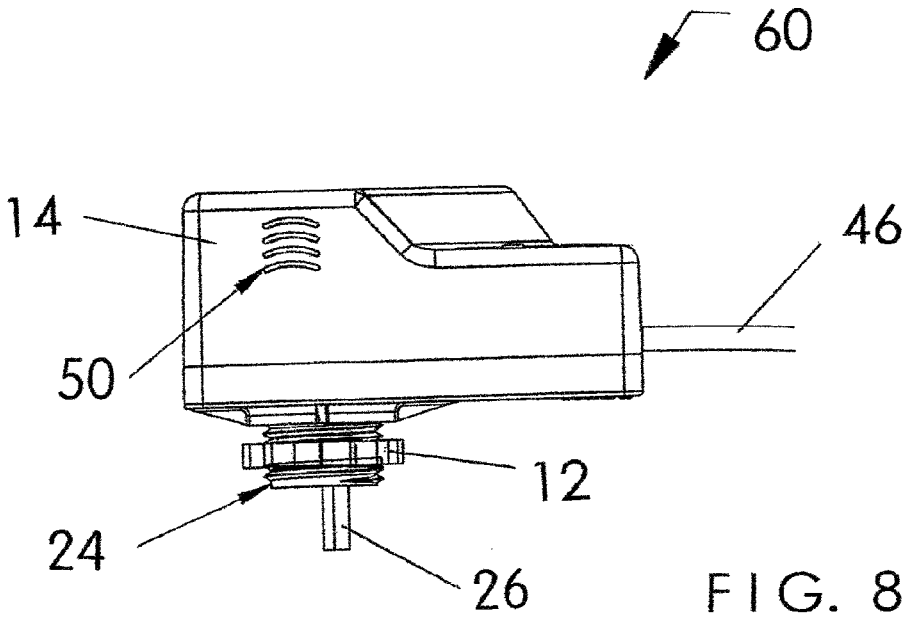
FIG. 8 is a side view of the alarm housing of the most preferred embodiment of the present invention having a pan sensor cable and power supply leads connected to it, and further having slots formed through the side of the alarm housing that allow someone nearby to more easily hear the audible signal generated by an alarm/buzzer within the alarm housing.
Figure 9:
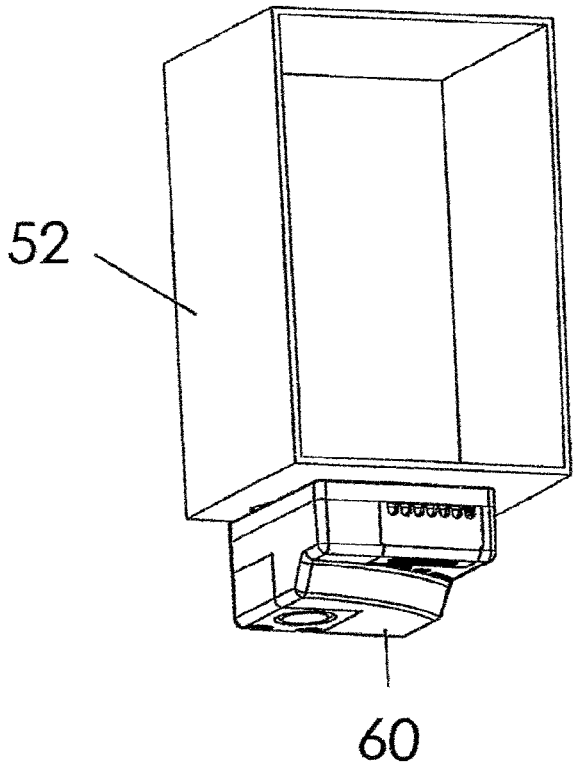
FIG. 9 is a perspective view of the alarm housing of the most preferred embodiment of the present invention mounted to the bottom of a disconnect box, with pan sensor wiring removed for clarity of illustration.
Figure 10:
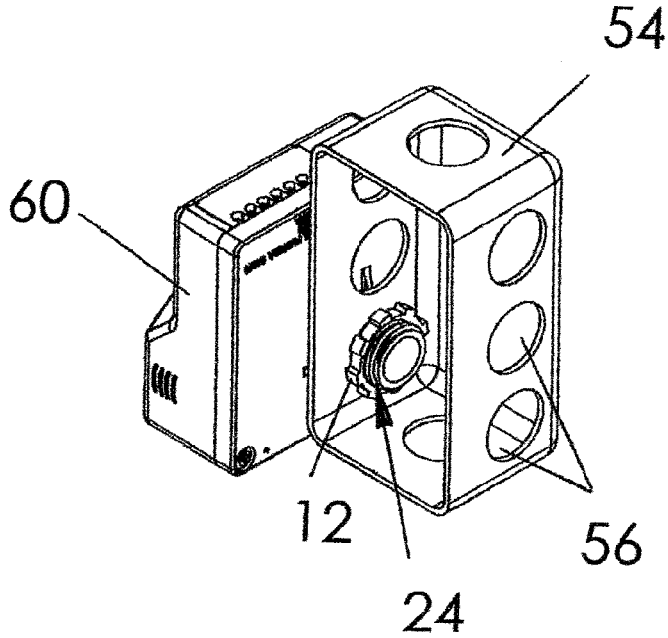
FIG. 10 is a perspective view of the alarm housing of the most preferred embodiment of the present invention mounted to the side of a handy box, with pan sensor wiring removed for clarity of illustration.

FIGS. 7-10 disclose exterior views of the alarm housing 60 used as a part of the most preferred embodiment of the present invention. The sheathed electrical cable 4 secured through knockout panel 48 has been omitted for clarity of illustration. FIG. 7 shows a perspective view of alarm housing 60 in an assembled condition as it would be for a top mount installation on storage hot water heater tank 58. Terminal block cover 16, line feed cover 10, and top portion 14 together form the upper part of alarm housing 60 that is secured to an independent base 22 (see FIG. 2). FIG. 7 further shows a pan sensor cable 46 connected through terminal block cover 16 and power supply leads 26 extending downwardly below alarm housing 60. In a top mounted installation of alarm housing 60 directly into storage hot water heater tank 58, it is these power supply leads 26 that extend downwardly through the top of storage hot water heater tank 58. FIG. 7 also shows the nut 12 securing the threaded stem 24 of the base 22 during installation of alarm housing 60, the reset button 20 positioned near terminal block cover 16 (that can also be lit to provide a visual indication of water leakage in storage hot water heater tank 58), screws 8 holding line feed cover 10 in a fixed position relative to top portion 14, and the knockout panel 48 that is removed for top installation of alarm housing 60 upon storage hot water heater tank 58. In addition, FIG. 8 provides a side view of alarm housing 60 in the most preferred embodiment of the present invention and shows multiple slots 50 formed through the side of the top portion 14, which allow someone near storage hot water heater tank 58 to hear the audible signal generated by the alarm/buzzer 18 positioned under and protected by top portion 14 when water leakage from storage hot water heater tank 58 has occurred. FIG. 9 provides a perspective view of the alarm housing 60 in the most preferred embodiment of the present invention mounted in an upside-down orientation to the bottom of a disconnect box 52, with pan sensor cable 46 removed for better visibility of alarm housing 60. In contrast, FIG. 10 is a perspective view of the alarm housing 60 of the most preferred embodiment of the present invention mounted to one of the side openings 56 in a handy box 54, with pan sensor cable 46 removed for better visibility of alarm housing 60.

Figure 11:
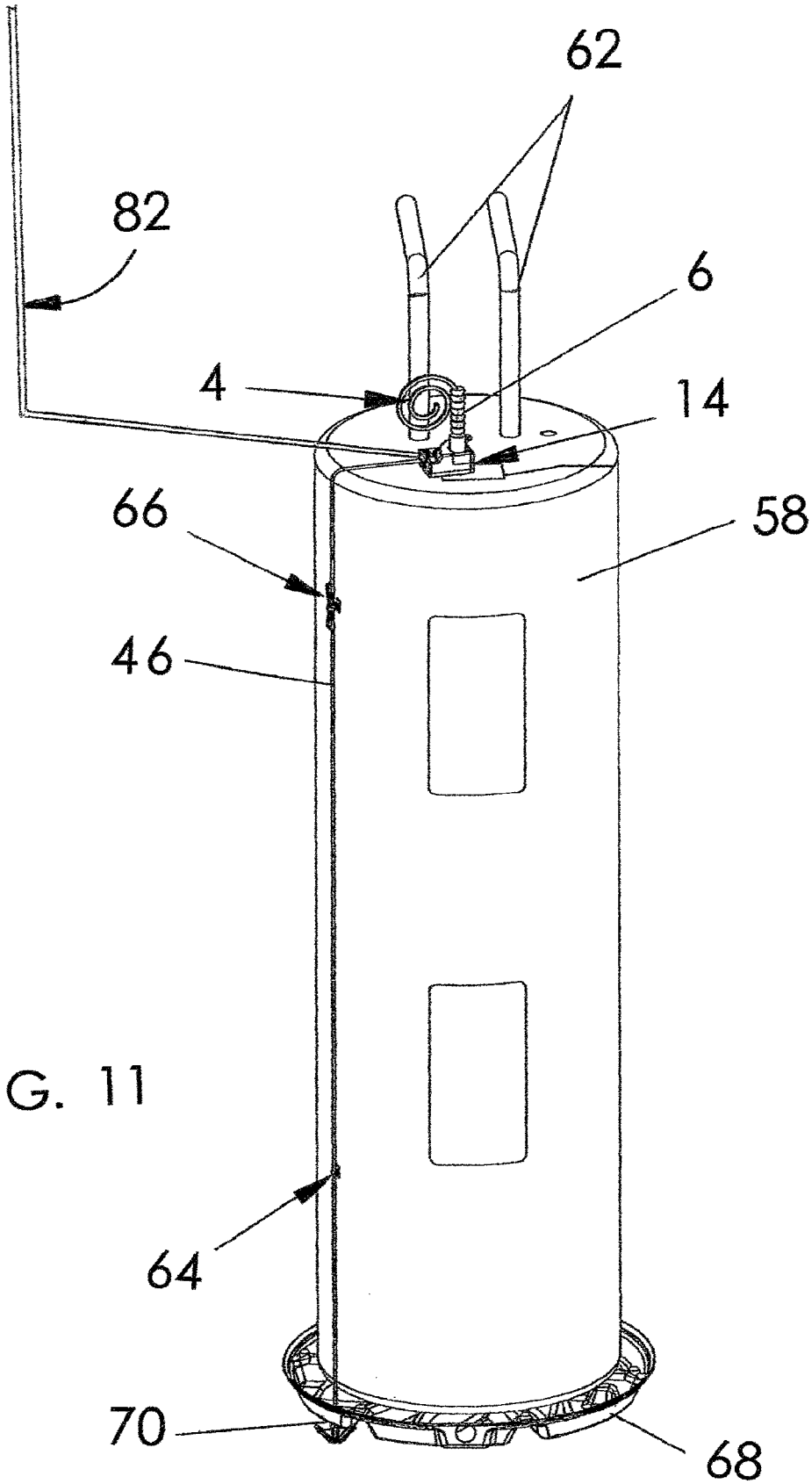
FIG. 11 is a perspective view of the most preferred embodiment of the present invention in association with a storage hot water heater tank, including a water collection pan, a fluid detection sensor, a pan sensor cable, surface mounts for the cable, an alarm housing, a sheathed power supply, and electrical wiring for remote notification of tank leakage.

FIG. 11 is a perspective view of the alarm system in the most preferred embodiment of the present invention in association with a storage hot water heater tank 58 having hot and cold water pipes 62 servicing it. FIG. 11 shows a top mounted installation of the present invention, with sheathed electrical cable 4 positioned above the top portion 14 of alarm housing 60 (prior to its connection to a municipal power supply) and EMT connector 6 positioned between sheathed electrical cable 4 and top portion 14. The power supply leads 26 extending downwardly from alarm housing 60 (and inserted through the top of storage hot water heater tank 58) are hidden from view in FIG. 11. FIG. 11 also shows hot water heater tank 58 supported upon a water collection pan 68 (also part of the present invention), which has sufficient volume to protect surroundings from slow leaks in tank 58, but not catastrophic failure thereof. Although not shown, a drain line could be connected to pan 68 in some applications. FIG. 11 also shows fluid detection sensor 70 positioned under water collection pan 68, and pan sensor cable 46 held in close association against the exterior surface of storage hot water heater tank 58 by surface mounts 64 and 66, with pan sensor cable 46 extending between fluid detection sensor 70 and the top part 14 of alarm housing 60. In addition, FIG. 11 shows the general representation of an additional cable or electrical wiring 82 connected to alarm housing 60 that could be used to carry a remote water leakage notification signal to a home security device (not shown), which might then relay it to a 24-hour security monitoring network.

Figure 12:
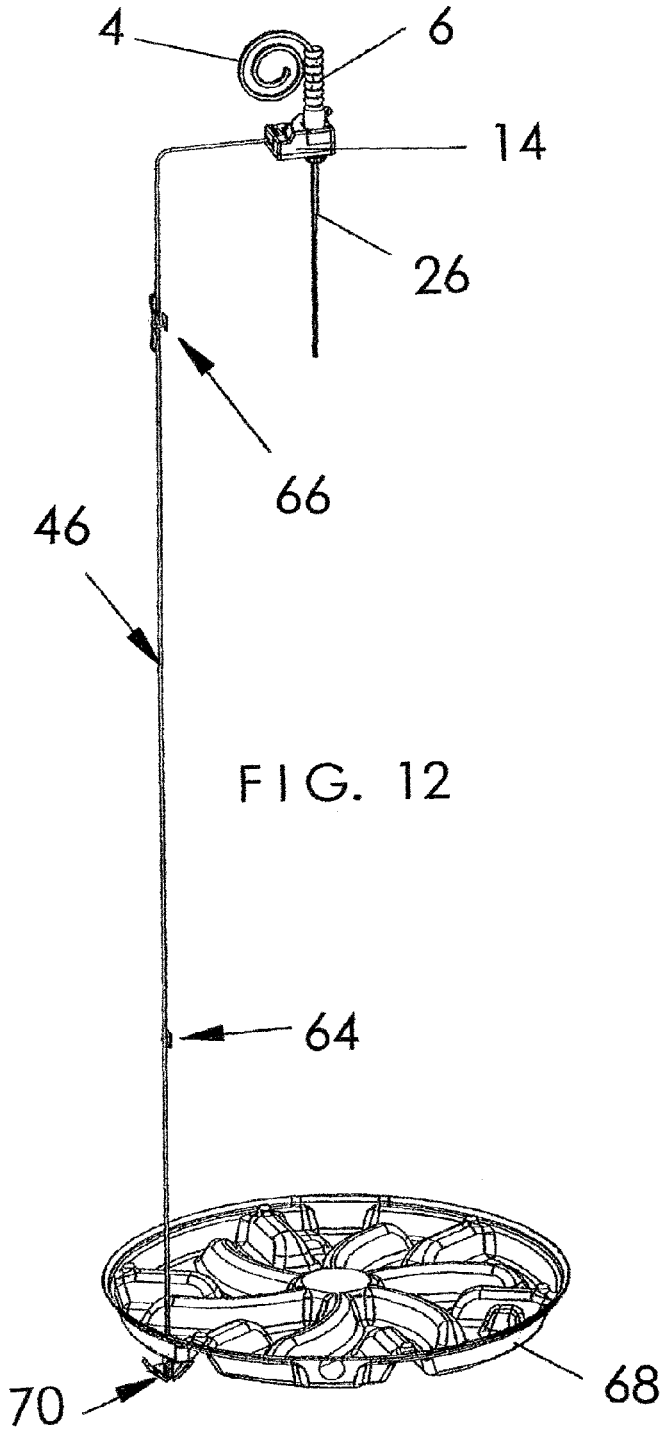
FIG. 12 is a side view of the most preferred embodiment of the present invention similar to that shown in FIG. 11, but with the storage hot water heater tank removed.
Figure 13:
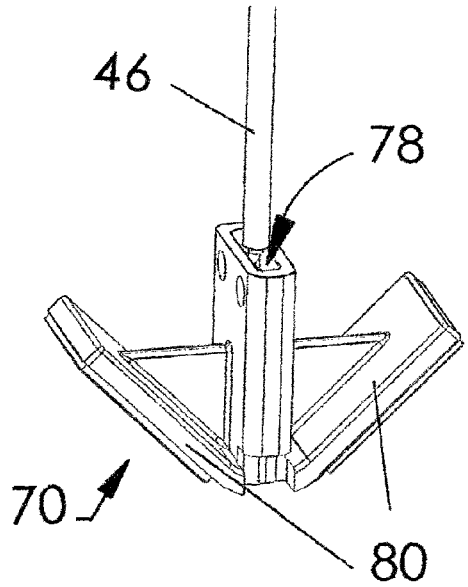
FIG. 13 is side view of the fluid detection sensor used as a part of the most preferred embodiment of the present invention.
Figure 14:
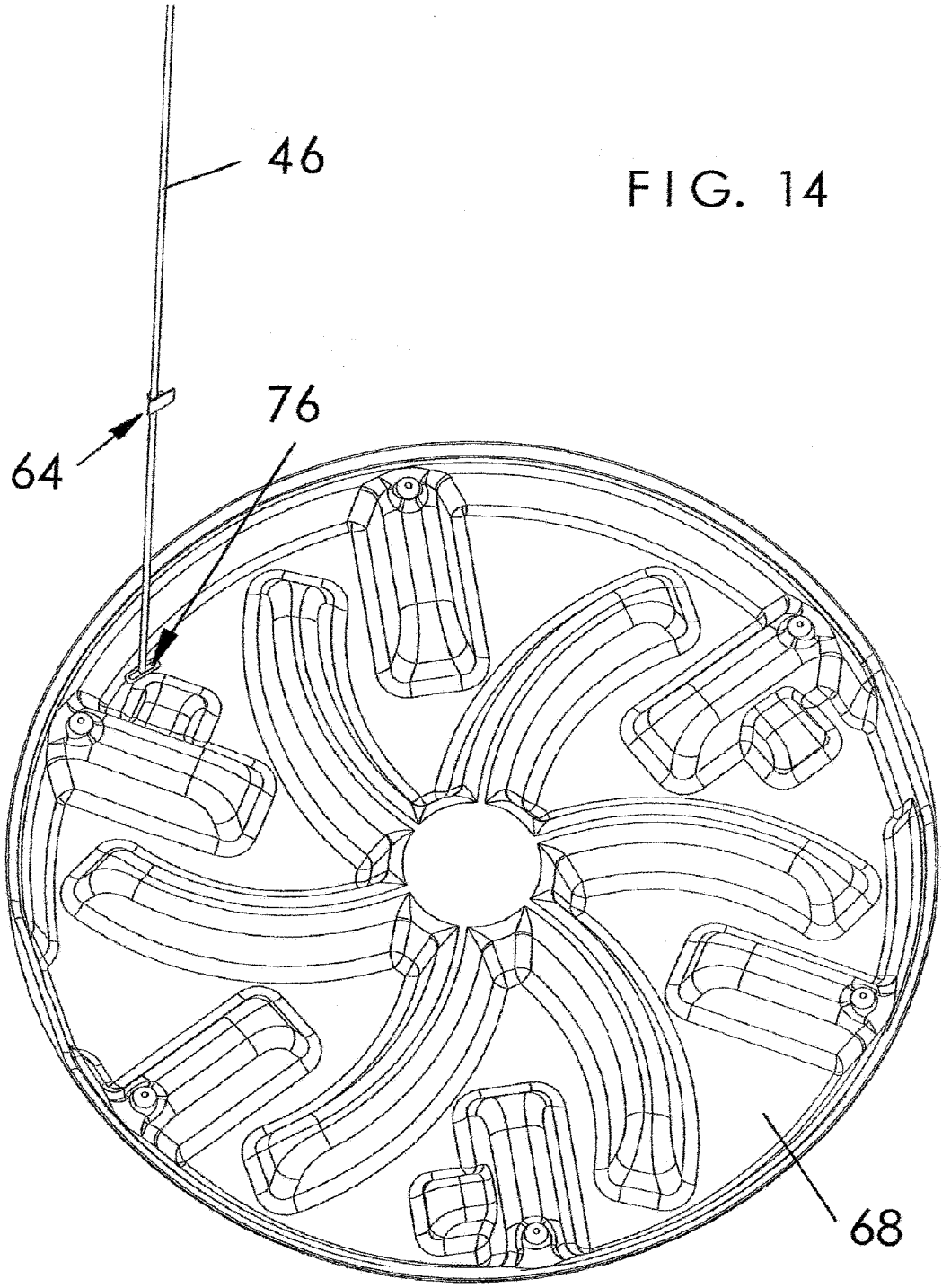
FIG. 14 is a top view of the pan used as a part of the most preferred embodiment of the present invention, with the pan sensor cable connected between a fluid detection sensor hidden under the pan and the alarm housing used for signal generation shown extending upwardly through a small opening in the pan.
Figure 15:
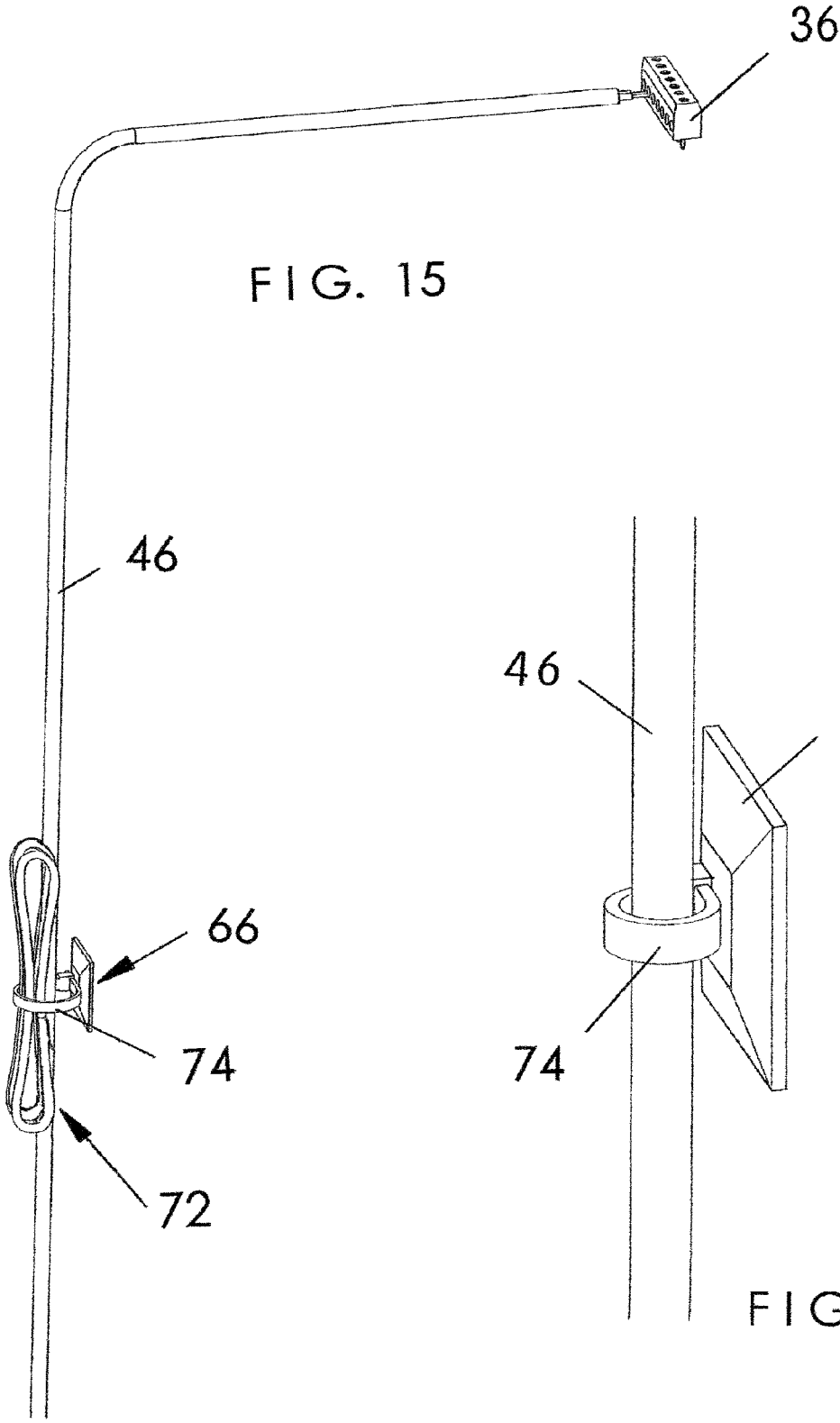
FIG. 15 is a side view of the upper portion of the pan sensor cable connected in the most preferred embodiment of the present invention between the fluid detection sensor and the alarm housing, and showing the cable connected to the alarm housing's terminal block, and also showing a surface mount used to compactly associate an excess portion of the electrical wiring against the exterior surface of a hot water heater tank.
Figure 16:
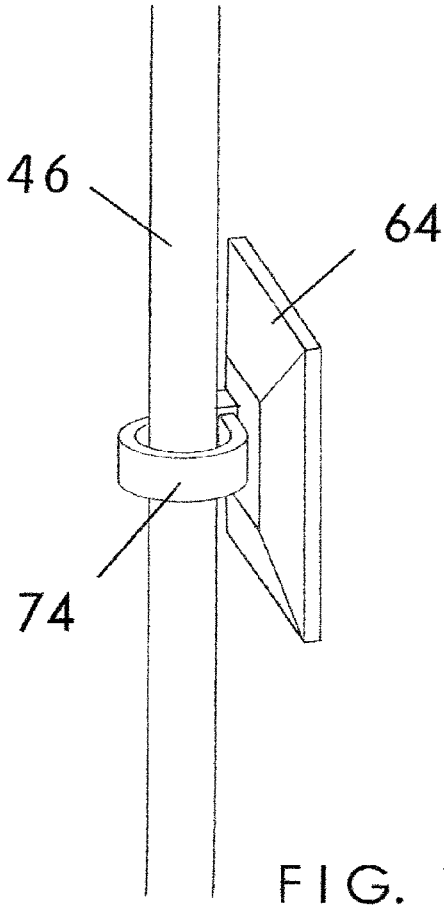
FIG. 16 is a side view of a portion of the pan sensor cable connected in the most preferred embodiment of the present invention between the fluid detection sensor and the alarm housing, and showing a surface mount used to closely associate the cable in an out-of-the-way position against the exterior surface of a storage hot water heater tank.

Lastly, FIGS. 12-16 show enlarged views of components that are preferably used in the most preferred embodiment of the present invention with automated alarm assembly 2, including the water collection pan 68, pan sensor cable 46, fluid detection sensor 70, pan sensor cable 46, and surface mounts 64 and 66. FIG. 12 is a side view of a top mounted present invention alarm system in combination with a fluid detection sensor 70 positioned under the water collection pan 68, a pan sensor cable 46 having surface mounts 64 and 66 associated with it, and pan sensor cable 46 extending between fluid detection sensor 70 and the top portion 14 of alarm housing 60. The components in FIG. 12 are identical to those shown in FIG. 11, with storage hot water heater tank 58 removed. FIG. 12 also shows the present invention alarm system 2 comprising a sheathed electrical cable 4 and EMT connector 6 extending upwardly from the top of portion 14 of alarm housing 60, and the power supply leads 26 extending downwardly below the top of portion 14 of alarm housing 60 (for insertion into a storage hot water heater tank 58). The number of surface mounts 64 and 66 used as a part of the present invention is not critical. However, it is preferred in the most preferred embodiment of the present invention that the number of surface mounts 64 and 66 used be sufficient for providing out-of-the-way positioning for pan sensor cable 46 to minimize contact with surroundings. FIG. 13 is side view of the fluid detection sensor 70 preferred as a part of the most preferred embodiment of the present invention. FIG. 13 shows fluid detection sensor 70 having a central water collection chamber 78 and the distal end of pan sensor cable 46 inserted downwardly into water collection chamber 78 so that a very small amount of tank leakage water in entering water collection chamber 78 will complete a circuit and cause alarm housing 60 to generate a leak notification signal. FIG. 13 also shows the fluid detection sensor in the most preferred embodiment of the present invention having opposing exterior braces 80 that are used for proper orientation and stable positioning of fluid detection sensor 70 under water collection pan 68 to ensure prompt signal generation after only a very small amount of leakage water (not shown) from tank 58 has been collected in pan 68. FIG. 14 is a top view of the water collection pan 68 that is preferred as a part of the most preferred embodiment of the present invention. FIG. 14 shows pan sensor cable 46 extending through a small laterally-positioned opening 76 in water collection pan 68 near one of its perimeter edges. Although not shown, the floor of pan 68 could be made with a slight incline to direct collected water promptly toward opening 76. Furthermore, while not marked with numerical identification, FIG. 14 shows raised supports are positioned within circumference, for use in supporting an upright storage hot water heater tank 58 above any collected leakage therefrom to reduce the likelihood of mold and algae growth on storage hot water heater tank 58 and reduce its rate of corrosion. FIG. 14 also shows one surface mount 64 attached to pan sensor cable 46. FIGS. 15 and 16 show enlarged views of surface mounts 64 and 66 each securing pan sensor cable 46 within a ring 74 that is preferably adjustable. FIG. 15 is a side view of the upper portion of pan sensor cable 46 connected between fluid detection sensor 70 (not shown in FIG. 15) and alarm housing 60 via its terminal block 36. The surface mount 66 in FIG. 15 contains surplus amount of pan sensor cable 46 in a compact/bundled configuration 72 within an attached adjustable ring 74. In contrast, FIG. 16 shows a single strand of pan sensor cable 46 positioned within a ring 74 attached to surface mount 64.

Although examples of the inventive compositions have been provided in the foregoing detailed descriptions, it should be understood that the invention is not limited only to the examples disclosed, but is intended to embrace any alternative, equivalent, modification, or rearrangement falling within the scope of the invention as defined by the following claims.

I claim:

1. An automatic alarm system for detecting slow leaks in a storage hot water heater tank and providing notification thereof, said system comprising:

an alarm housing having circuitry and components therein connected to a circuit board and configured to generate and transmit an electrical leak notification signal;

a sheathed electrical cable connected on one of its ends to a source of electrical power and having an opposed end configured for electrical connection;

an electrical metallic tubing connector having an integral adjustable clamp and a threaded stem adjacent to said adjustable clamp, said sheathed electrical cable secured to said connector via said adjustable clamp;

a nut with threads complementary to said threaded stem of said connector, said nut securing said connector to said alarm housing so that said opposed end of said cable configured for electrical connection is placed in electrical communication with said circuit board;

power supply leads inserted through the top of a hot water heater tank, said power supply leads in electrical communication with said circuit board in said alarm housing;

a water collection pan positioned under the storage hot water heater tank and configured to support the storage hot water heater tank in an elevated position, said pan having a small perimeter fluid discharge opening it its bottom surface;

a fluid detection sensor associated with said water collection pan, said sensor having a top opening similar in size and configuration to said fluid discharge opening in said pan, said sensor also located under said pan in a position that allows fluid communication between said fluid discharge opening in said pan and said top opening in said sensor wherein prompt signal generation occurs after only a very small amount of water collects in said pan; and electrical connection means adapted to provide electrical communication between said fluid detection sensor and said circuitry in said alarm housing, wherein when a threshold amount of water slowly leaking from the storage hot water heater tank contacts said fluid detection sensor, an electrical circuit is completed that causes said circuitry in said alarm housing to electrically generate a leak notification signal.

2. The alarm system of claim 1 wherein said fluid detection sensor located below said fluid collection pan has bracing means adapted to provide proper orientation and stable positioning of said fluid detection sensor for prompt signal generation after only a very small amount of water from the hot water heater tank has been collected in said water collection pan.

3. The alarm system of claim 2 wherein said bracing means comprises a centrally located water collection chamber and two angled braces in a substantially perpendicular orientation to one another, and further with each such angled brace depending laterally from said water collection chamber in an opposite direction from the other.

4. The alarm system of claim 1 wherein said sensor positioned under said water collection pan has a water collection chamber aligned with said opening in said pan for receipt of water passing through said opening, and further wherein said electrical connection means comprises a cable that passes through said opening, with said cable having an unsheathed end positioned within said water collection chamber.

5. The alarm system of claim 1 further comprising at least one surface mount configured to maintain said electrical connection means in close association against the storage hot water heater tank while it is supported by said water collection pan.

6. The alarm system of claim 5 wherein said at least one surface mount has an adjustable ring.

7. The alarm system of claim 1 wherein insertion of said power supply leads through the top of the hot water heater tank is tamper-resistant.

8. The alarm system of claim 1 wherein said leak notification signal is selected from a group consisting of audible leak notification signals, visual leak notification signals, leak notification signals sent electrically to a remote location, and leak notification signals transmitted through a home security device to a 24-hour security monitoring network.

9. The alarm system of claim 8 wherein said alarm housing has at least one slot therethrough that is configured to facilitate projection of said audible leak notification signals beyond said alarm housing.

10. The alarm system of claim 1 wherein said alarm housing is configured for easy mounting into a usable position, and said usable position is selected from a group consisting of mounting to the top of a storage hot water heater tank, mounting to a disconnect box, and mounting to a handy box.

11. The alarm system of claim 1 further comprising a reset button extending through said alarm housing that is in electrical communication with said circuitry within said alarm housing and configured for placement of said alarm system back into a leak detection mode after a power outage or signal generation.

12. The alarm system of claim 11 wherein said reset button becomes lit to provide a visible indication of water leak detection.

13. The alarm system of claim 1 wherein said alarm housing has a detachable line feed cover.

14. The alarm system of claim 13 wherein said detachable line feed cover has a knockout panel configured for use in securing said sheathed electrical cable to said alarm housing.

15. The alarm system of claim 1 wherein said alarm housing has a detachable terminal block cover.

16. The alarm system of claim 15 wherein said alarm housing further comprises a detachable line feed cover with a knockout panel configured for use in securing said sheathed electrical cable to said alarm housing.

17. The alarm system of claim 1 wherein said alarm housing further comprises a base with a threaded stem.

18. The alarm system of claim 1 wherein said electrical communication between said sheathed electrical cable and said alarm housing is provided by an insulated connector and an adjustable clamp.

19. The alarm system of claim 18 wherein said insulated connector has an end with a threaded stem.

20. The alarm system of claim 19 wherein said alarm housing has a detachable line feed cover with a knock out panel and a nut having internal threads securing said threaded stem of said insulated connector to said line feed cover through a void space remaining in said line feed cover after said knockout panel is removed.

* * * * *